US010016047B2

(12) United States Patent
Waddy

(10) Patent No.: US 10,016,047 B2
(45) Date of Patent: Jul. 10, 2018

(54) HAMMOCK WITH ADAPTER PANEL

(71) Applicant: WARBONNET OUTDOORS LLC, Evergreen, CO (US)

(72) Inventor: Kenneth Brandon Waddy, Evergreen, CO (US)

(73) Assignee: Warbonnet Outdoors LLC, Evergreen, CO (US)

( * ) Notice: Subject to any disclaimer, the term of this patent is extended or adjusted under 35 U.S.C. 154(b) by 201 days.

(21) Appl. No.: 14/883,520

(22) Filed: Oct. 14, 2015

(65) Prior Publication Data

US 2016/0045017 A1 Feb. 18, 2016

Related U.S. Application Data

(62) Division of application No. 12/807,667, filed on Sep. 10, 2010, now Pat. No. 9,192,224.

(60) Provisional application No. 61/276,433, filed on Sep. 11, 2009.

(51) Int. Cl.

| | |
|---|---|
| ***A45F 3/22*** | (2006.01) |
| ***A47C 17/84*** | (2006.01) |
| *A47C 17/86* | (2006.01) |
| *A45F 3/52* | (2006.01) |

(52) U.S. Cl.

CPC ..... *A45F 3/22* (2013.01); *A47C 17/84* (2013.01); *A45F 3/52* (2013.01); *A47C 17/86* (2013.01)

(58) Field of Classification Search

CPC ..... A47C 17/64; A47C 17/66; A47C 17/78; A47C 17/84; A47C 17/86; A45F 3/22; A45F 3/52

See application file for complete search history.

(56) References Cited

U.S. PATENT DOCUMENTS

| | | | | | |
|---|---|---|---|---|---|
| 688,029 | A | * | 12/1901 | Palmer | A45F 3/22 5/121 |
| 717,119 | A | * | 12/1902 | Potter | A45F 3/22 5/122 |
| 773,317 | A | | 10/1904 | Funke | |
| 773,817 | A | * | 11/1904 | Funke | B41K 3/005 101/100 |
| 1,156,200 | A | * | 10/1915 | Ashworth | A45F 3/22 5/121 |
| 1,401,846 | A | * | 12/1921 | Russell | A45F 3/22 5/121 |
| 2,375,792 | A | * | 5/1945 | Kearny | A45F 3/22 5/121 |
| 2,467,890 | A | * | 4/1949 | Harvey | A45F 3/22 5/122 |
| 4,001,902 | A | * | 1/1977 | Hall | A45F 3/22 5/121 |

(Continued)

*Primary Examiner* — Nicholas F Polito
*Assistant Examiner* — David R Hare
(74) *Attorney, Agent, or Firm* — Trenner Law Firm, LLC; Mark D. Trenner

(57) ABSTRACT

The disclosure includes a hammock made of a flexible piece of material whose ends can be gathered into endpoints where the suspension system is attached so that the hammock can be suspended between two points (trees/posts/etc). The hammock is covered with a flexible material (such as mosquito netting/fabric/etc) so that the hammock is enclosed. On one or both sides of the hammock an adapter panel is attached between the canopy and the hammock body.

19 Claims, 16 Drawing Sheets

(56) References Cited

U.S. PATENT DOCUMENTS 4,071,917 A * 2/1978 Mojica ..... A45F 3/22 135/90
4,308,883 A * 1/1982 Malone ..... A45F 3/22 135/90
4,686,720 A * 8/1987 Newell ..... A45F 3/22 5/121
RE33,232 E * 6/1990 Fausett ..... A45F 3/22 211/87.01
5,715,552 A * 2/1998 DeAth ..... A45F 3/24 135/117
5,857,231 A * 1/1999 Wade ..... A45F 3/22 150/154
5,913,772 A * 6/1999 Clark ..... A45F 3/22 5/121
6,185,763 B1 * 2/2001 Hennessy ..... A45F 3/22 5/120
6,389,620 B1 * 5/2002 Hennessy ..... A45F 3/22 5/120
6,421,851 B2 7/2002 Hennessy
6,701,549 B1 * 3/2004 Eriksen ..... A45F 3/22 5/120
6,865,757 B2 * 3/2005 Hennessy ..... A45F 3/22 5/120
7,020,915 B1 * 4/2006 Helsdon ..... A45F 3/22 5/121
D607,662 S 1/2010 Ellison
7,699,068 B2 * 4/2010 Helsdon ..... A45F 3/22 135/90
8,296,880 B1 * 10/2012 Hennessy ..... A45F 3/22 5/120
9,192,224 B1 * 11/2015 Waddy ..... A45F 3/22
2005/0177938 A1 * 8/2005 Steiner ..... A45B 3/00 5/121
2009/0065036 A1 * 3/2009 Johnson ..... A45F 3/22 135/95
2009/0165205 A1 * 7/2009 Hennessy ..... A45F 3/22 5/122
2009/0265851 A1 * 10/2009 Clark ..... A45F 3/22 5/122
2011/0010849 A1 * 1/2011 Lemmens ..... A45F 3/22 5/123
2014/0158174 A1 * 6/2014 Rhett, Jr. ..... E04H 15/34 135/121
2014/0304911 A1 * 10/2014 Kramer ..... A45F 3/22 5/121

* cited by examiner (PRIOR ART)

(PRIOR ART)

Fig. 3a
(PRIOR ART)
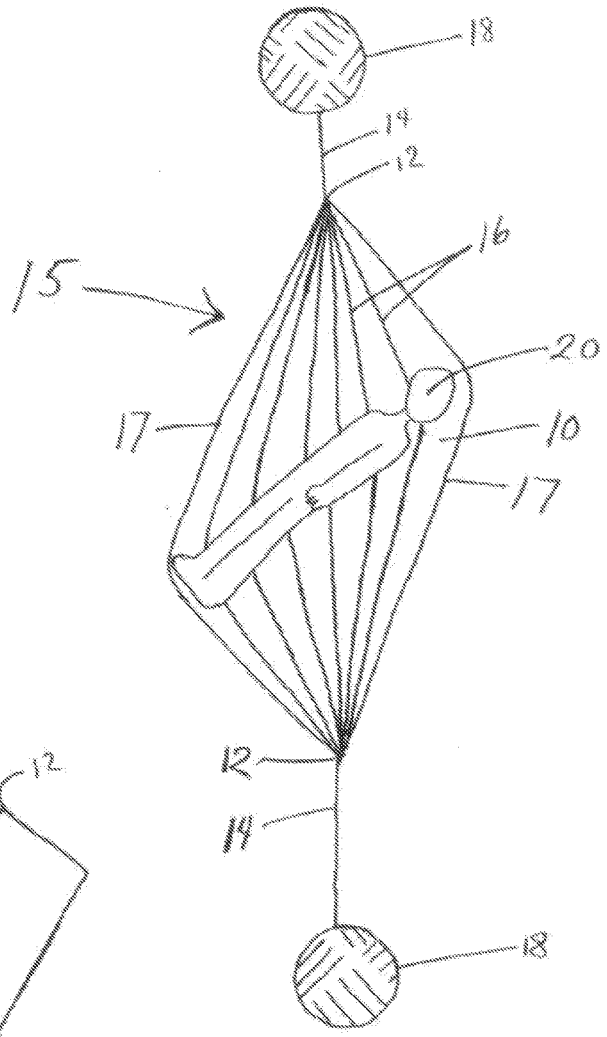
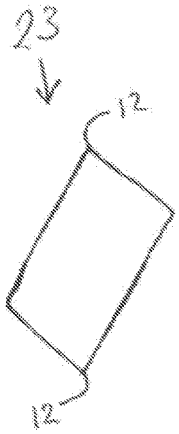
Fig. 3b (PRIOR ART)

HAMMOCK WITH ADAPTER PANEL

This application claims priority from provisional application No. 61/276,433 filed on Sep. 11, 2009 incorporated herein by reference.

BACKGROUND OF THE INVENTION

Field of the Invention

The present invention relates to end gathered hammocks, particularly those fitted with canopies or netting.

Traditionally, end gathered hammocks (such as those based on Mayan and Brazilian styles) are made from wide pieces of fabric and meant to be laid in diagonally in order to achieve a flat lay (suitably flat sleeping surface).

Lying diagonally in such a hammock naturally forces the loose edges of the hammock body into a certain shape (an asymmetric parallelogram), which is also referred to as "the natural shape of the diagonal position". This allows the user to achieve a somewhat flat sleeping surface (desirable).

Prior to the creation of the present invention, if mosquito netting was to be fitted to those loose edges in such a way as to be minimal and tight fitting (often desired for aesthetic and weight reduction purposes), the shape of canopy used had to resemble the natural shape of the diagonal position (as seen in U.S. Pat. No. 6,865,757). If it didn't would restrict the hammock body and greatly reduce head/foot room and thus force the user into more of an "in-line" position rather than the preferred "diagonal position" (as seen in U.S. Pat. No. 6,421,851). This loss of diagonal potential decreases both flatness and comfort.

Being restricted to using only the natural shape of the diagonal position for the shape of the canopy/netting in order to achieve comfort and roominess is not nearly as desirable as being able to use almost any shape a designer wishes while still keeping all its benefits.

SUMMARY

This invention incorporates the often-used combination of hammock body and attached canopy/mosquito netting. It also incorporates a new piece, the adapter panel, which is attached between the edge of the hammock body and the edge of the mosquito netting. It acts like an adapter, allowing the hammock body itself to assume the general natural shape of the diagonal position (which is needed for proper comfort) which allowing one to use just about whatever shape they wish for the shape of the canopy, and doing this without having to worry about causing any restriction to the hammock body (so as not to negatively affect diagonal lay/position/comfort/roominess/etc.). In addition, the adapter panel also creates a large out-of-the-way storage shelf. This is extremely beneficial, as storage space is commonly lacking in current hammock designs and is particularly needed in the camping hammock variety.

Certain embodiments of an improved covered hammock comprise an adapter panel connecting (by means of existing between) a generally rectangular hammock body and a canopy (which can have various shapes). The canopy can be made of fabrics of various weaves, or nonwoven materials, ranging from closely woven, opaque materials to mesh or netting. Commercial insect netting materials of various types can be used, possibly even comprising metal or plastic fibers as alternatives to cloth fabrics.

Thanks to the use of the adapter panel (often made of solid fabrics similar to those used in the hammock body), which is fitted between the edge of the hammock body and the edge of the canopy, the canopy can now have almost any shape. The adapter panel eliminates the previous requirement that the shape of the canopy must conform to the desired contours of the edge of the occupied hammock body.

The edges of the hammock body can be provided with attachments for lines, which can be used to exert tension on the sides to spread the hammock out. The terms "head" and "foot" signify the ends of the suspended hammock closest to the head and feet, respectively, of an occupant of the hammock.

The adapter panel, which comprises at least two sides or edges, resides between the edge of the hammock body and the edge of the canopy and can have almost any shape. That shape is determined as follows: one edge of the adapter panel will conform to the contour or form of the edge of the hammock body, and the other edge of the adapter panel will conform to the contour or form of the edge of the chosen canopy shape. The function of the adapter panel (aside from creating a storage shelf) is to allow the two differently contoured edges (no matter how different they are from one another) to be precisely fitted together by means of the adapter panel positioned between them. Another way of understanding this arrangement is to think of the hammock and attached canopy as somewhat like a hollow tube of fabric that tapers toward the ends. The adapter panel is shaped in such a way that it adds girth in areas that need it so that the tapering shape of the canopy won't pull the hammock body out of the desired position so as not to restrict room in the head and foot areas. By adding fabric/girth in a few strategic spots, unwanted restriction to the hammock body can be avoided. The location of these key spots would of course be very dependent on the shape of canopy used and the needs of the designer. The preferred embodiment of the concept that is shown in FIG. 7-11 is designed specifically for one shape of canopy, and it adds fabric only where its needed, and only in the needed amount. This avoids loose excess fabric in spots where it isn't needed and is the main force behind giving the adapter panel its unique, fitted shape. Changing the shape of the canopy while using the same design tactics would alter the shape of the adapter panel.

The edge of the adapter panel that attaches to the hammock body will preferably conform to something that generally resembles the natural shape of the diagonal position (or rather one edge/side/half of such a shape) so as to allow the loose edges of the hammock body to take on this desired shape when assembled. The other edge of the adapter panel conforms to the contours along the edge of the canopy, which thanks to the adapter panel, is no longer limited in its shape. The relationship between the two is such that the shape chosen for the shape of the canopy will determine the contour that one edge of the adapter panel will need to conform to. The preferred embodiment shown in FIGS. 7-11 (the shapes of which were chosen for practical purposes and are in no way mandatory) has an adapter panel with a narrow mid-section and wider portions towards the ends, which correspond to the head and foot ends of the hammock when installed. The end of the adapter panel attached to the canopy adjacent the head-end of the hammock body can be termed the "shelf-portion" of the adapter panel, as it creates a flat area adjacent to the occupant's head inside the hammock and provides a shelf area for storage of personal effects. Similarly, the opposite end of the adapter panel can be termed the "footbox portion", as it allows that portion of hammock body to protrude freely where the canopy would otherwise force it to taper. While in prior art covered hammocks (such as U.S. Pat. No. 6,865,757) the canopy is specifically shaped to conform to the desired shape of the suspended, occupied hammock to avoid adverse effects to the hammock body (which would cause discomfort and loss of interior space, particularly in the head and foot areas, to the occupant). The embodiments disclosed herein provide for the installation of adapter panels to join hammock bodies and canopies of various shapes and sizes in a manner which allows the edges of the gathered, suspended hammock body to smoothly assume the basic natural shape or orientation of a "diagonal body position" when occupied regardless the shape of the canopy. Naturally, certain adjustments in the contours and shapes of the canopy and adapter panel will be necessary for hammock bodies of various proportions and shapes may be altered significantly to provide larger or smaller shelf or footbox areas in the occupied hammock. Additionally, different shapes altogether could be employed. For example, certain different shapes will allow for multiple shelves in different locations if so desired, or the shapes might be changed in order to incorporate different shaped canopies for purely aesthetic reasons. As mentioned above, the presence of a shelf inside the hammock is particularly desirable for camping use so the canopy shape might even be changed or chosen simply to facilitate a change to the shelf portion of the adapter panel. Designing for a bigger shelf, one with a different shape, or simply wanting it in a different location would affect the shape of the adapter panel as well.

The connections between the adapter panel, canopy, and hammock body can be permanent as with conventional sewn, riveted, or cemented seams, or can employ temporary attachments along at least one of the connection seams to provide for removable attachment of the canopy or adapter panel components to the hammock body. This can be useful when no canopy is needed (such as when "mosquito season" is over). The main requirement is that the edges are sufficiently joined to one another; how they are joined is much less crucial. The four most common attachment methods would likely be sewn or welded seams for permanent attachment and zipper or hook and loop combination (like Velcro) for removable attachment.

Thus, the embodiments disclosed herein provide an improvement on a hammock comprising a generally rectangular hammock body which is gathered at the ends and suspended by these gathered ends and having a canopy attached removably or permanently, by providing an adapter panel attached removably or permanently between the hammock body and the canopy to connect an edge of a canopy to an edge of a hammock body. The adapter panel is shaped and attached between the hammock body and canopy so as to permit the hammock body to assume a proper shape when occupied regardless of the shape of the canopy.

BRIEF DESCRIPTION OF THE DRAWING

FIG. 3A shows an overhead perspective view of FIG. 2 with an occupant inside.

FIG. 3B shows the shape assumed by the loose edges of the hammock body when an occupant lies in the preferred diagonal position.

DETAILED DESCRIPTION OF PREFERRED EMBODIMENTS

Figure 5B:
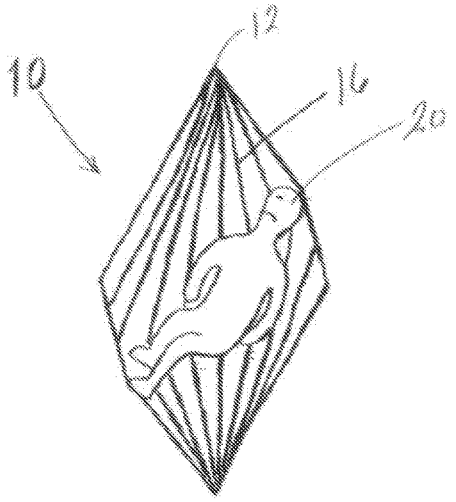
Fig. 5b (PRIOR ART)
FIG. 5B is an overhead view of an occupied version of FIG. 5A.
Figure 5C:
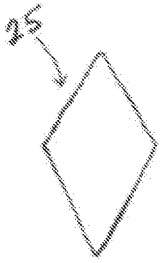
FIG. 5C is an outline of the general shape that the edges of the hammock body of FIGS. 5A and B are forced into as a result of the chosen canopy shape.
Figure 5A:
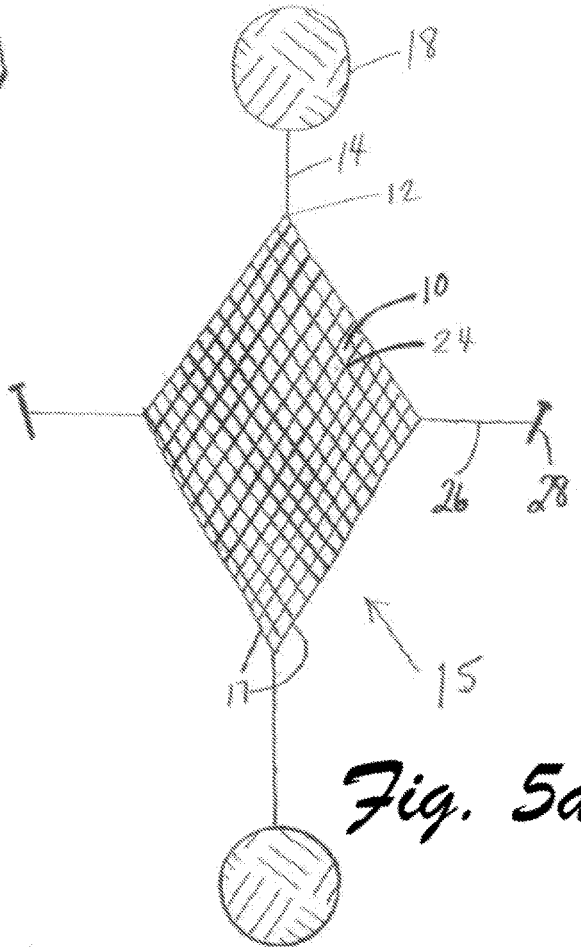
FIG. 5A shows an overhead view of a hammock with the same hammock body as FIGS. 2, 3 and 4, where a constrictive shape is used for the shape of the netting/canopy.
Figure 6A:
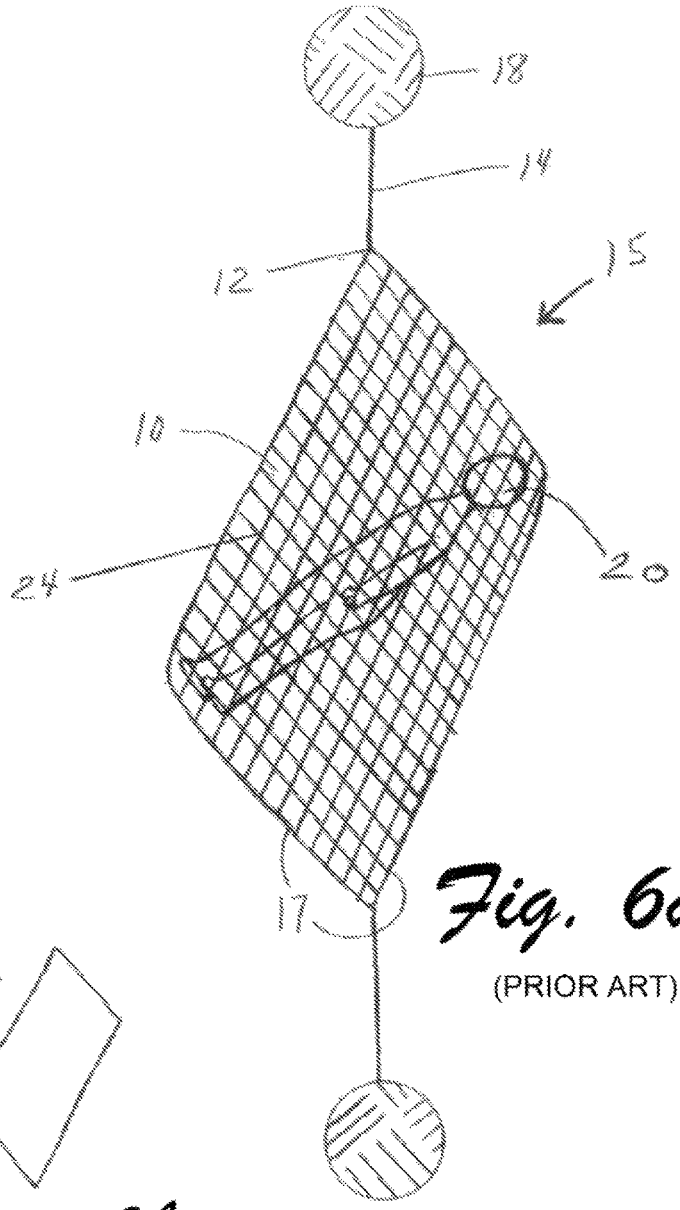
Fig. 6a (PRIOR ART)
FIG. 6A is an overhead view of an improved version of FIG. 5A, similar to the hammock of U.S. Pat. No. 6,865,757.

The disclosed embodiments, various forms of which are illustrated in FIG. 7-16, are improvements over the prior art designs shown in FIGS. 5 and 6.

Figure 1:
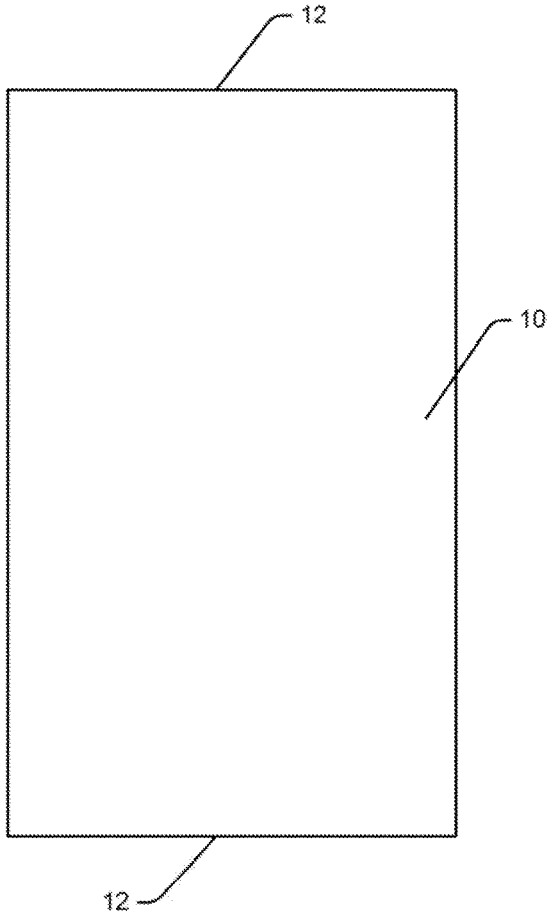
FIG. 1 shows a plan view of a prior art hammock body.
Figure 2:
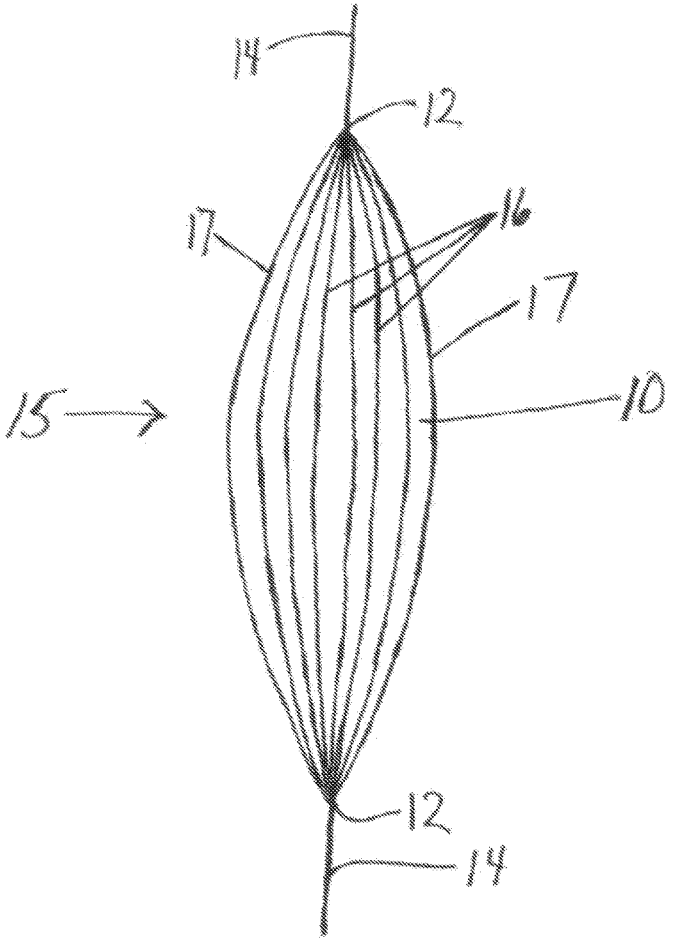
FIG. 2 shows an overhead view of FIG. 1 once each end has been gathered into a single point for the attachment of the suspension.

In FIG. 1, the rectangular hammock body (10) has end-edges (12) that will be gathered into single points for the attachment of a suspension system (14). FIG. 2 shows the hammock body (10) of FIG. 1 after these two end-edges (12) have been gathered into points and a suspension system (14)

has been attached creating a prior art hammock. Once the end-edges (12) of the hammock body (10) are gathered, folds or wrinkles (16) will often be created. The non-gathered edges (17) remain loose and flexible. Once the suspension line (14) is attached to supports (18) as shown in FIG. 3A, the prior art hammock (15) will support an occupant (20). Notice how the flexible edges (17) of the hammock body (10) will naturally conform to a certain shape when the occupant (20) lies in the preferred diagonal position. This shape is referred to as the "natural shape of the diagonal position" (23), as shown in FIG. 3B. For a shape to have the benefits of the "natural shape of the diagonal position" (23), it only needs to "generally resemble" the natural shape of the diagonal position (23)/FIG. 3B). The important aspects of such a shape being that the corner or obtrusion on one side of the shape protrudes closer to one suspension point, while the corner or obtrusion on the other side of the shape protrudes closer to the opposite suspension point so that the two protrusions are "offset" from one another (as shown in FIGS. 3A and 3B) rather than being "even with" one another as in FIG. 5. Ideally, these "corners" will correspond to the points on the hammock where the occupant's head and feet protrude the farthest. A shape having offset opposite corners or obtrusions as described above is referred to as "generally resembling the natural shape of the diagonal position" (27) (such as the shape seen in FIG. 9B), and if a hammock body's (10) flexible edges (17) assume this general shape, the hammock body will have all the benefits thereof, such as a roomy, flat, diagonal lay for the occupant (20). However, if the flexible edges (17) of a hammock body (10) assume a shape that has corners or obtrusions that are "even with" one another, the diagonal potential of the hammock body (10) will be restricted and comfort will be negatively effected as seen in FIG. 5B. If the corners were instead aligned with the head and feet, the hammock would provide a more comfortable and spacious sleeping area. A shape that does not allow for the protrusion of one's head and feet is referred to as a "constrictive shape" (25) because head and foot room would be diminished.

Figure 4:
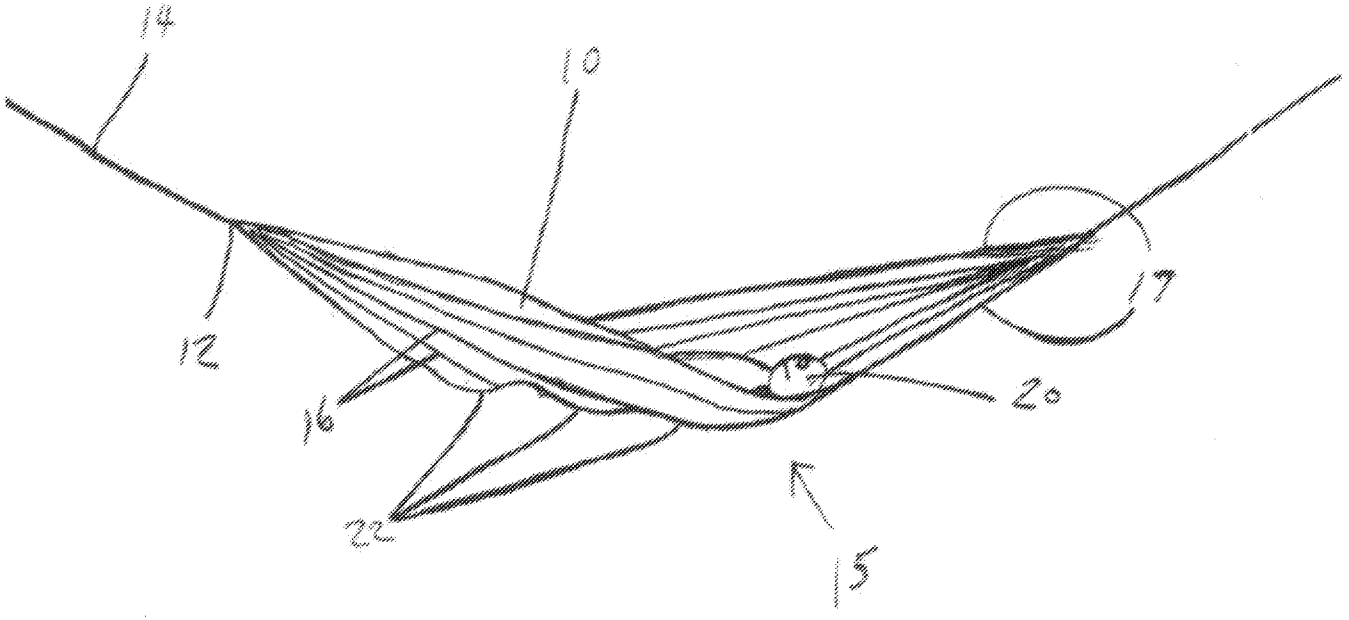
Fig. 4 (PRIOR ART)
FIG. 4 shows a side perspective view of FIG. 3A.

As seen in FIG. 4 (which is simply a side perspective view of FIG. 3) the hammock body (10) will tend to conform to the contours (22) of the occupant's (20) body.

Figure 6B:
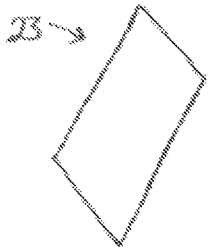
FIG. 6B is an outline of the general shape that the edges of the hammock body from FIG. 6A are forced into as a result of the chosen canopy shape.

As shown in FIG. 5, if the flexible edges (17) of the hammock body (10) are forced into a "constrictive shape" (25), the ability to lie diagonally (and as result the comfort) will be diminished. This is shown in FIGS. 5A, B and C. In FIG. 5B, the netting canopy is intentionally omitted to better show the hammock fabric and the occupant. The flexible edges (17) of the hammock body (10) are forced into a "constrictive shape" (25) which, in this case, is dictated mainly by the chosen shape of the mosquito netting canopy (24), and possibly to some extent by the guyline (26) (usually small diameter cordage that is attached and then tensioned via a tent stake (28) or equivalent. Guyline (26) made of static cordage could help to fix the flexible edges (17) into a "constrictive shape" (25) whereas guyline (26) made from elastic or stretchy cordage would not). As a result of the "constrictive shape" (25) forced onto the flexible edges (17) of the hammock of FIG. 5, the hammock body (10) no longer facilitates the preferred diagonal position. This loss of diagonal potential reduces roominess, flatness, and comfort as visible in FIG. 5B. However, as shown in FIG. 6, if the flexible edges (17) are allowed to conform to the "natural shape of the diagonal position" (23/FIG. 6B) as result of a netting canopy (24) of the same shape (23), the hammock body (10) will fully facilitate the preferred diagonal position for the occupant (20) and the comfort and roominess it provides will not be diminished.

Figure 7B:
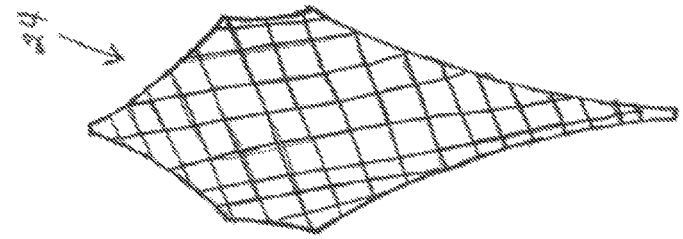
FIG. 7B shows the canopy/netting.
Figure 7A:
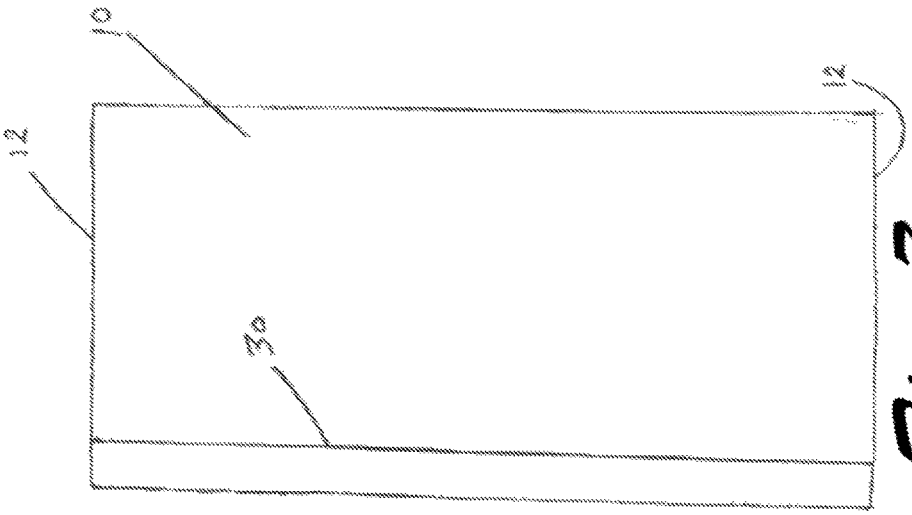
FIG. 7A shows the hammock body.
Figure 7C:
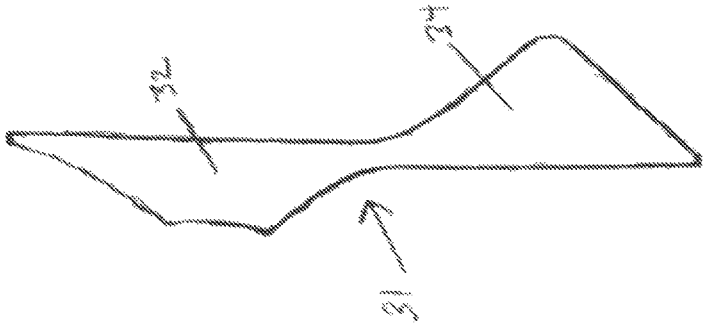
FIG. 7C shows the adapter panel.
Figures 8A, 8B:
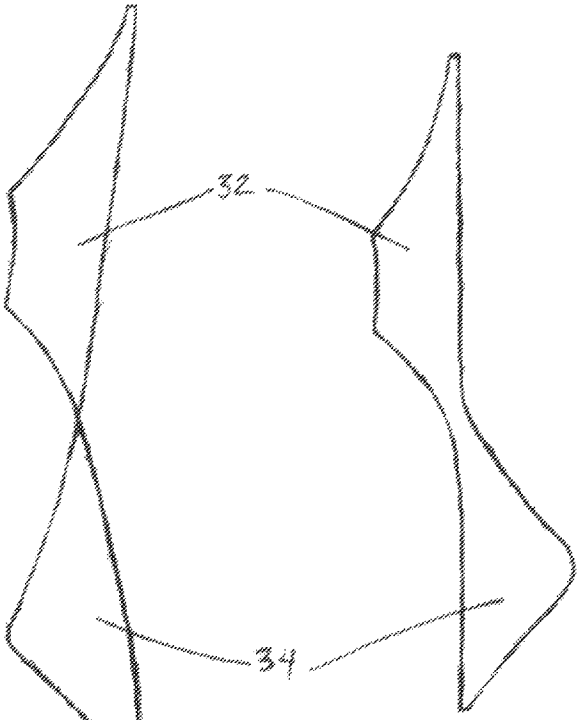
FIG. 8A is a plan view of the adapter panel.
FIG. 8B is an overhead view of the panel as it twists in actual use.
Figure 15C:
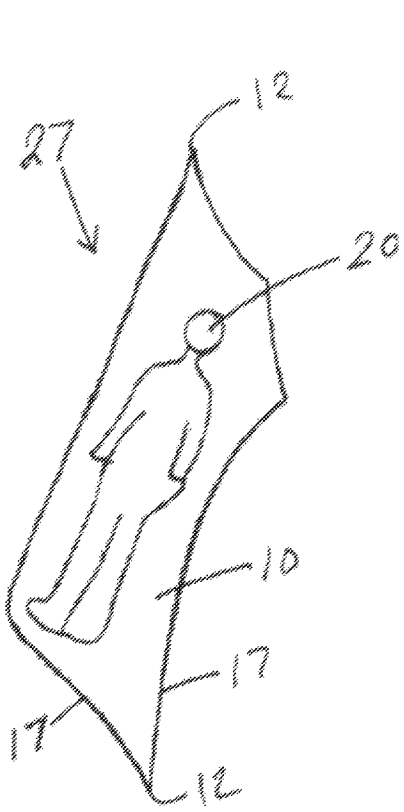
FIG. 15C is an overhead view of the resulting shape that the edges of the hammock body will be forced into.
Figure 15B:
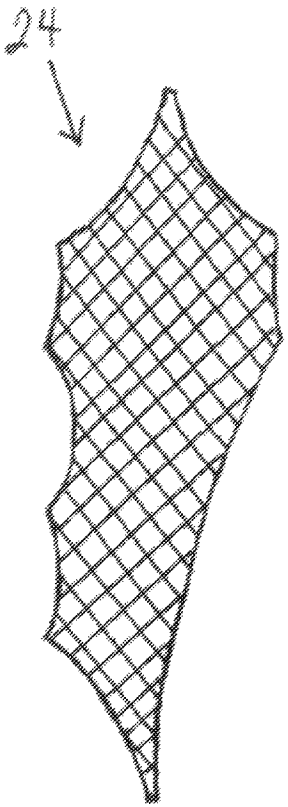
FIG. 15B is a plan view of the corresponding netting shape.
Figure 15A:
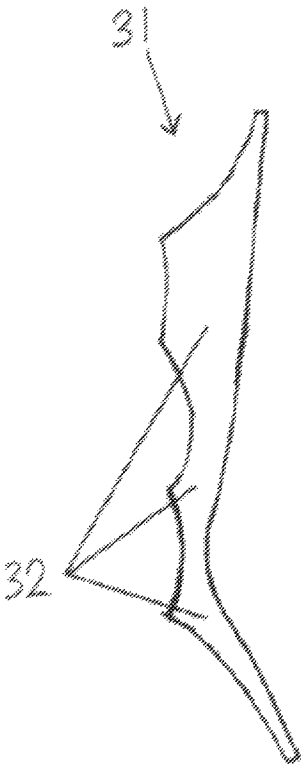
FIG. 15A is a plan view of one example of yet another shape that could be used for the adapter panel.
Figure 16A:
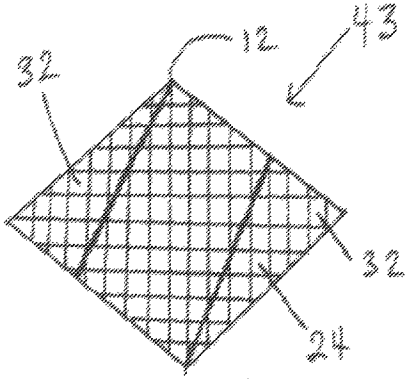
FIG. 16A is an overhead view of an example of another embodiment of the disclosure.
Figure 16B:
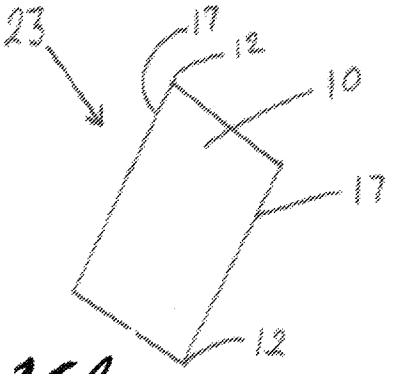
FIG. 16B shows an overhead view of the resulting shape that the hammock body will be forced into.
Figure 16C:
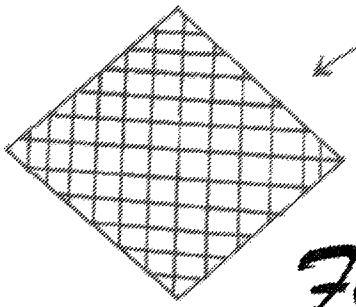
FIG. 16C is a plan view of the two adapter panels.
Figure 16D:
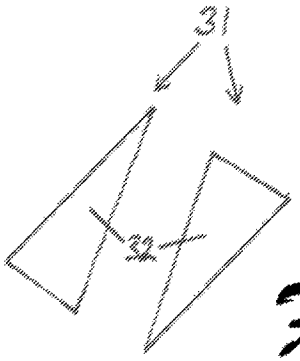
FIG. 16D is a plan view of the corresponding canopy shape.

As shown in FIG. 7, the current disclosure (FIGS. 7-16) comprises a hammock body (10) with its yet-to-be-gathered end-edges (12), a canopy (24) and at least one adapter panel (31). FIGS. 7A, B and C show a plan view of one embodiment of these components. Also visible is a zipper (30), which is shown in FIG. 7A. As shown in FIG. 7C, this particular embodiment of the adapter panel (31) has two main parts, the shelf portion (32) and the footbox portion (34). FIG. 8 illustrates how the adapter panel (31) will twist in actual use, with FIG. 8A showing the plan view and FIG. 8B showing the overhead view of it twisted as it does in use. The adapter panel (31) will not twist in every embodiment of the disclosure, however this function is merely a result of the particular shapes used. For instance, a different canopy shape could be chosen that would require both portions of the adapter panel (31) to be shelf portions (32), and this embodiment of the adapter panel (31) would not twist. Components of such an embodiment can be seen in FIG. 15 where the netting canopy (24/FIG. 15B) requires an adapter panel (31/FIG. 15A) that is one long shelf portion (32). As seen in FIG. 15C, the flexible edges (17) of the hammock body (10) forms a shape that "generally resembles the natural shape of the diagonal position" (27), such a shape will provide ample head and foot room to the occupant (20). Another example of an embodiment (43) of the disclosure that is quite different from the current preferred embodiment (41) is shown in FIG. 16. Due to the shape of the canopy (24/FIG. 16D), two adapter panels (31/FIG. 16C) are used; each adapter panel (31) is comprised of only one portion, the shelf portion (32). Notice how the flexible edges (17) of the hammock body (10) still assume the "natural shape of the diagonal position" (23). FIG. 16A illustrates how these components fit together to form a hammock that is an embodiment of the disclosure (43). FIGS. 15 and 16 show how varied the components of the disclosure can be for various embodiments. Since the adapter panel makes it possible to use virtually any shape for the canopy, it creates a situation where widely varied canopy shapes will in turn create the need for widely varied adapter panels to fit them.

Figures 9A, 9B:
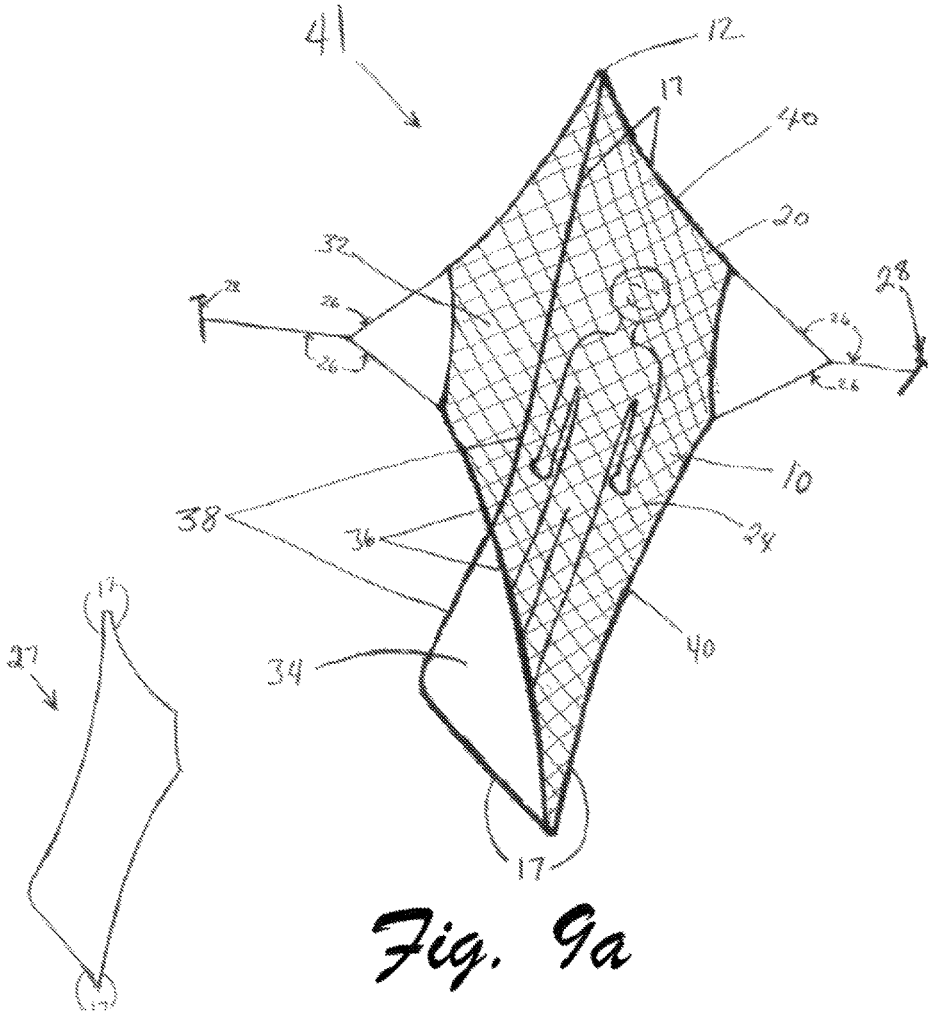
FIG. 9A is an overhead view of a hammock made from the components of FIGS. 7A, B and C.
FIG. 9B is an outline of the general shape that the edges of the hammock body of FIG. 9A are forced into as a result of the chosen shapes of the canopy and adapter panel.

Once the components of FIG. 7 are assembled together, they form a hammock that is a current preferred embodiment of the disclosure (41). (It is a current preferred embodiment for practical reasons; for instance, it has what has been determined to be an optimal combination of features, simplicity, value, effectiveness etc.) Notice how the hammock of FIG. 9A uses a netting/canopy shape other than "the natural shape of the diagonal position" (23); this canopy shape would be considered a constrictive shape (restrictive in the foot area), but because of the use of the adapter panel (32,34), the edges (17) of the hammock body (10) are still able to assume a shape that generally resembles the natural shape of the diagonal position (27/FIG. 9B), and no restriction is caused. As shown in FIG. 9A, the occupant (20) has the same opportunity for lying diagonal (with the flatter lay and ample head/foot room that it affords) as he does in FIGS. 3, 4, and 6, but the designer is not restricted to using a canopy shape similar to that used in FIG. 6 to avoid causing restriction like that caused in FIG. 5. As with the prior art hammock of FIG. 6, the occupant (20) is able to achieve a comfortable diagonal position without restriction, and additionally has the benefit of a large, much-needed, out-of-the-way storage shelf (32), while the designer now has the ability to use many, various, creative shapes instead of being restricted only to canopy (24) shapes that generally resemble the natural shape of the diagonal position (27, FIG. 6, FIG.

Figure 13C:
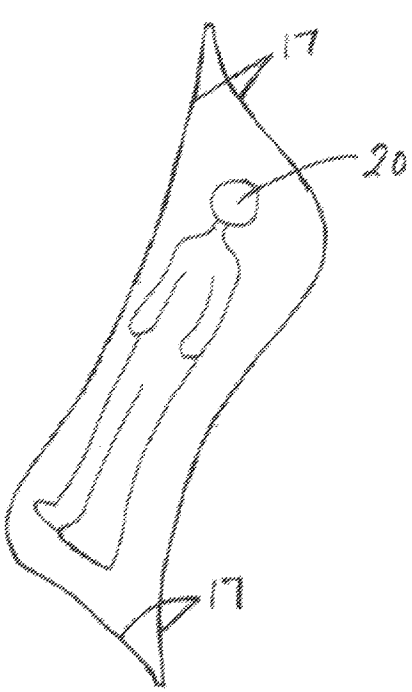
FIG. 13C is an overhead view of the resulting shape that the edges of the hammock body will be forced into.

12C, FIG. 13C, etc.) FIG. 9A also shows where the components of FIG. 7 are attached together. You can see the seam that attaches the netting canopy (24) to the adapter panel (32/34), which is labeled "36". Also visible is the seam that attaches the flexible edges (17) of the hammock body (10) to the adapter panel (32/34). This seam is labeled "38". And finally, the seam that attaches the netting canopy (24) to the flexible edges (17) of the hammock body (10) is labeled "40". In a current preferred embodiment of the disclosure (41) these components are attached together via sewn seams; however, other means could be used including (but not limited to) hook and loop combinations, zippers, button snaps, sufficient adhesive, some fabric welding, lamination, etc.

Figure 10:
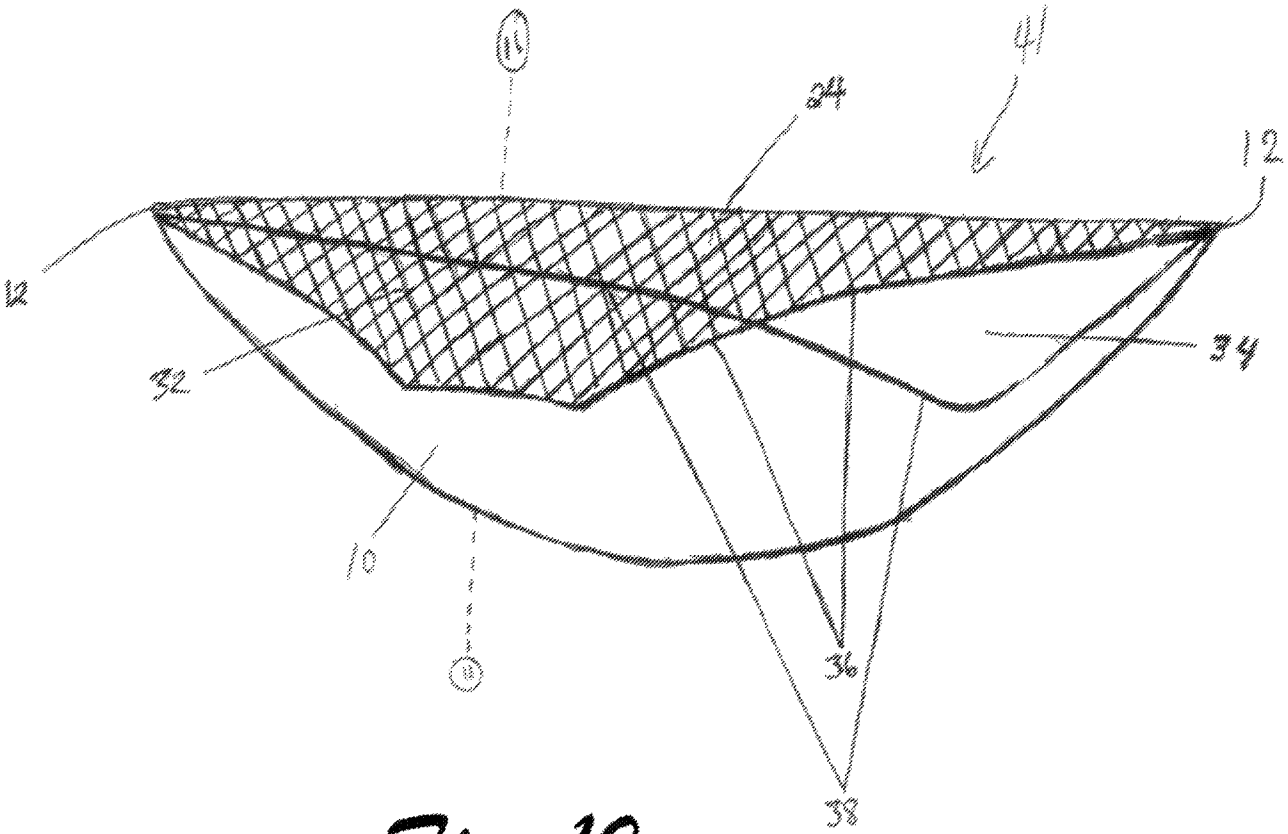
FIG. 10 is a side perspective view of FIG. 9A.
Figure 11:
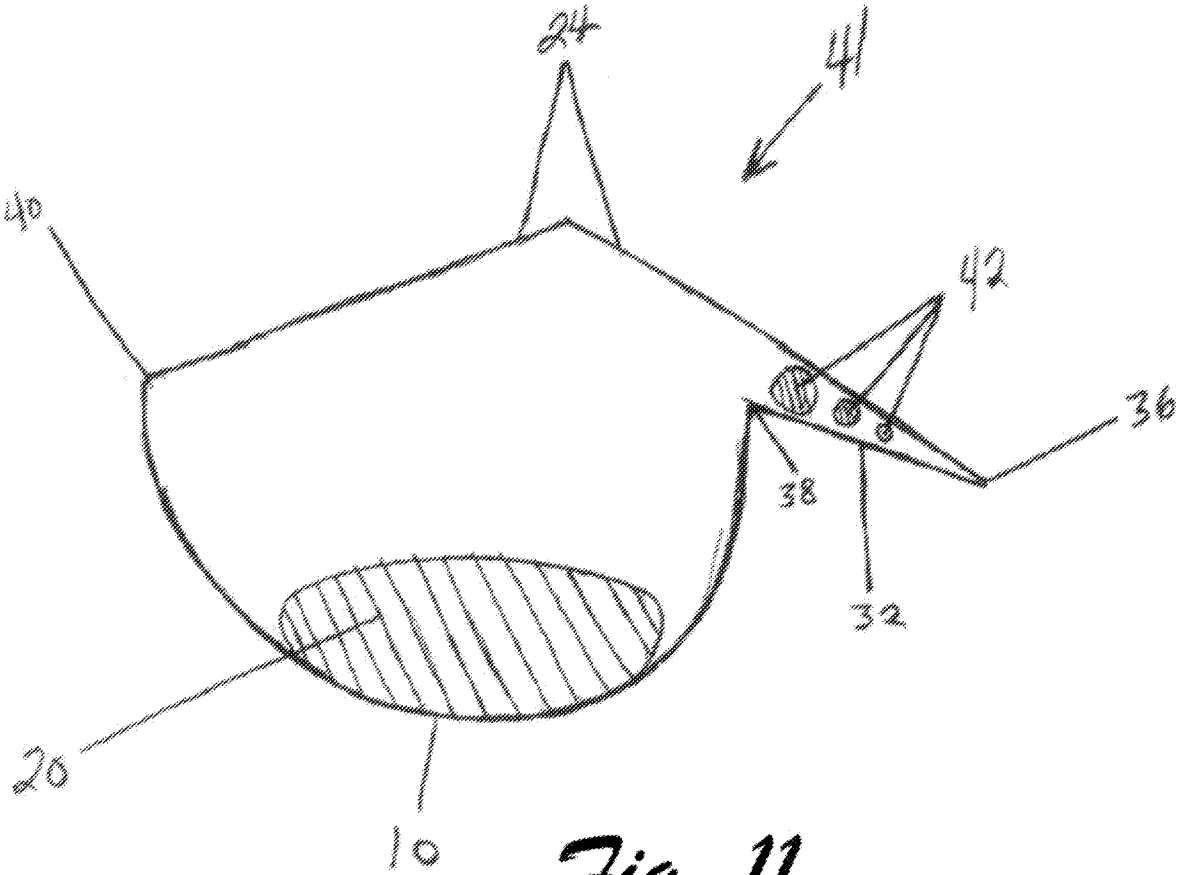
FIG. 11 shows an end cross-section view of the hammock of FIGS. 9 and 10.

In FIG. 10 you see a side perspective view of FIG. 9 with a different perspective of the components 10, 12, 24, 32, 34, 36 and 38. The location of the end cross-section view of FIG. 11 is shown as well. FIG. 11 shows items (42) being stored in the shelf (32) along with the seams (36, 38, and 40) that connect the three main components of FIG. 7 together. The netting canopy (24) hammock body (10) are visible as well as the approximate upper torso cross-section of the occupant (20) to give an idea of where the body rests in relation to the other components.

Figure 12C:
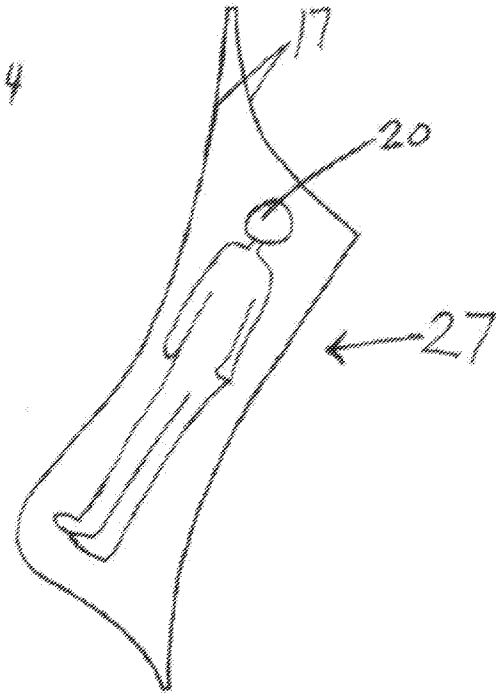
FIG. 12C is an overhead view of the resulting shape that the edges of the hammock body will be forced into.
Figure 12B:
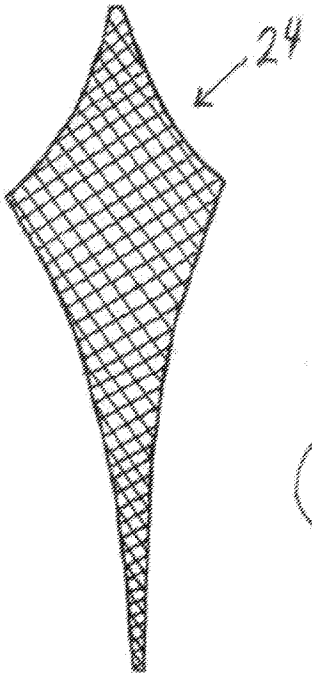
FIG. 12B is a plan view of the corresponding netting shape.
Figure 12A:
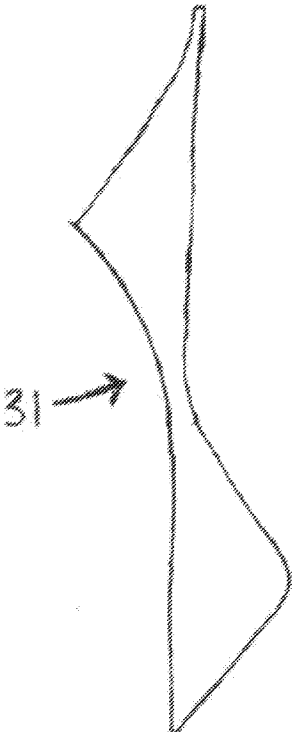
FIG. 12A is a plan view of one example of another shape that could be used for the adapter panel.
Figure 13B:
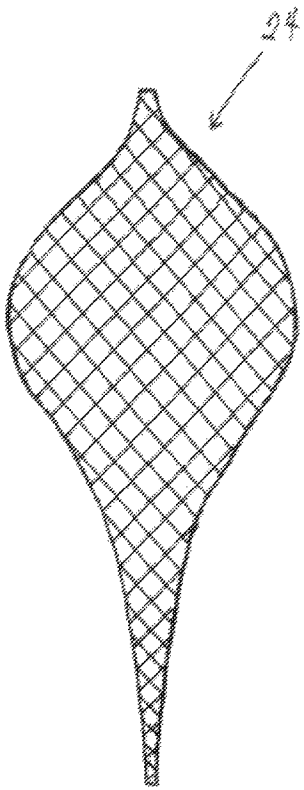
FIG. 13B is a plan view of the corresponding netting shape.
Figure 13A:
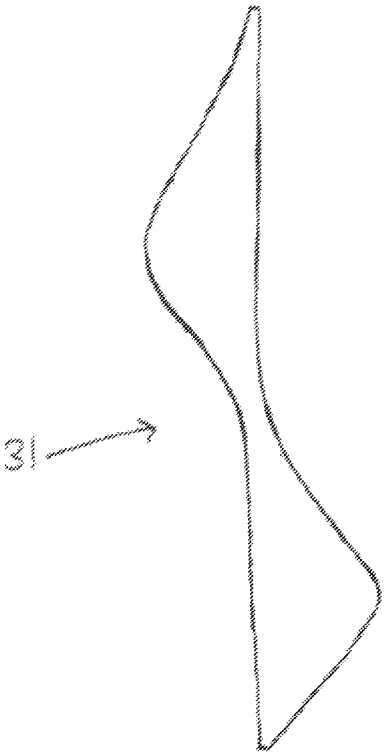
FIG. 13A is a plan view of one example of yet another shape that could be used for the adapter panel.

FIGS. 12 and 13 show embodiments of the disclosure that are very similar in shape and use to the components of the current preferred embodiment (41) shown in FIGS. 7-11. They are shown to help show the relationship between the shape of the canopy (24), the shape of the edges (17) of the hammock body (10), and the shape of the adapter panel (31) needed to join them together. FIGS. 12B and 13B show possible canopy shapes. FIGS. 12C and 13C show the corresponding shapes taken on by the edges (17) of the hammock body (10) when an appropriate adapter panel is utilized. FIGS. 12A and 13A show the necessary adapter panel (31) shape that is needed to connect these three components together. It should be noted that the adapter panel (31) of both FIG. 12A and FIG. 13A will twist in actual use just like the adapter panel (31) of the current preferred embodiment of the disclosure (41) illustrated in FIG. 8B.

Figure 14C:
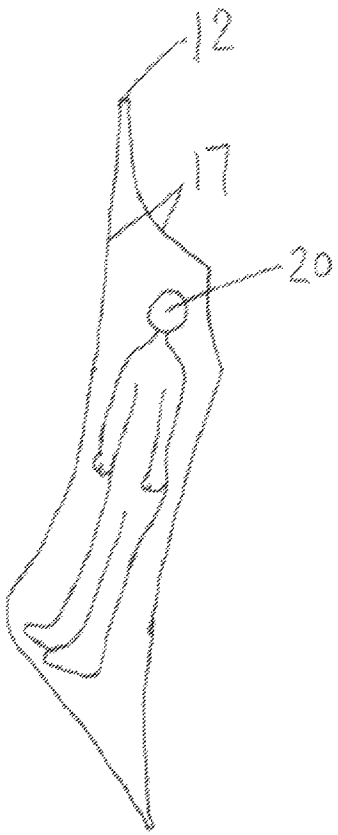
FIG. 14C is an overhead view of the resulting shape that the edges of the hammock body will be forced into.
Figure 14B:
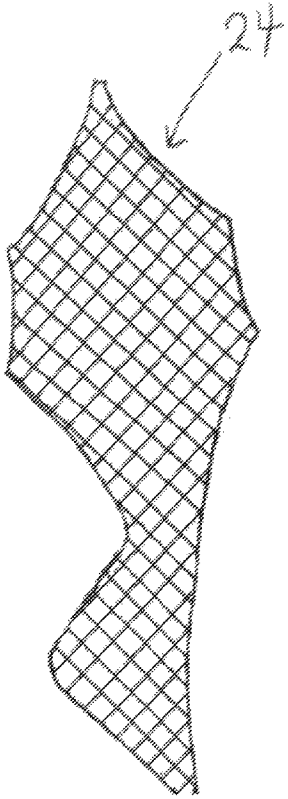
FIG. 14B is a plan view of the corresponding netting shape.
Figure 14A:
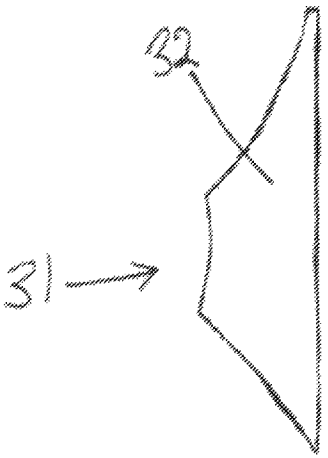
FIG. 14A is a plan view of yet another example of another shape that could be used for the adapter panel.

FIG. 14 shows another example of an embodiment of the disclosure. It is meant to point out that, although not as practical as a preferred embodiment, the footbox portion (34) of the adapter panel (31) can be excluded from the adapter panel (31) altogether if its shape is incorporated into the shape of the canopy (24) itself (as seen in FIG. 14B). Again, you can see the relationship between the shape of the canopy (FIG. 14B), the shape taken on by the edges (17) of the hammock body (10) and the required shape of the adapter panel (FIG. 14) needed to join them together.

As described in more detail earlier (in relation to FIG. 8), FIGS. 15 and 16 show embodiments of the disclosure that look and act somewhat differently than those embodiments shown in FIGS. 7, 12, 13 and 14. However, its the function of the adapter panel (31) (first explained on p. 3 line 15) that is important. Despite these differences, the shape of the adapter panel (31) is still determined by the two differently contoured edges (the edge of the desired shape (27) of the hammock body (10) and the edge of the canopy (24)) that it will join together.

It should also be noted that while the disclosure is an improvement specifically to end-gathered hammocks, the adapter panel (and its resulting shelf) could be an improvement to non-end gathered hammocks such as those described in U.S. Pat. No. 717,119, which is incorporated herein by reference. Also, the current disclosure describes hammock fabric that is generally rectangular; however, some variations to the rectangle would not affect the effectiveness of the disclosed components. Shapes such as those described in U.S. Pat. No. 6,865,757 could also be improved upon by the disclosed components, so U.S. Pat. No. 6,865,757 is incorporated herein by reference as well. It should also be noted that the embodiments shown have all been hammocks having only two gathered ends, but hammocks with more gathered ends would be improved as well. A hammock designed for two people might have two head ends and one to two foot ends, for a total of 3-4 gathered ends. An example of such a hammock can be seen in the U.S. published patent application 20090265851, so U.S. Patent Application No. 20090265851 is incorporated herein by reference as well.

I claim:

1. A hammock comprising:

a hammock body having side edges and end edges;

a canopy having a substantially diamond shape, the canopy joining to the hammock body along one of the side edges of the hammock body;

an adapter panel with a shape corresponding to the shape of the canopy, the adapter panel having a first longitudinal edge and a second longitudinal edge spaced apart by a body of the adapter panel, the adapter panel joining to the hammock body along only the first longitudinal edge of the adapter panel, and the adapter panel joining to the canopy along only the second longitudinal edge of the adapter panel, wherein the body of the adapter panel joins the hammock body to the canopy;

a shelf formed at an intersection of said canopy joining to said adapter panel, said shelf formed from a portion of said adapter panel; and a foot box formed at an intersection of said hammock body joining to said adapter panel, said foot box formed from a portion of said hammock body.

2. The hammock of claim 1 wherein the second longitudinal edge of the adapter panel is on an opposite side of the adapter panel from the first longitudinal edge of the adapter panel.

3. The hammock of claim 1 wherein at least a portion of the canopy comprises netting.

4. The hammock of claim 1 wherein the adapter panel is shaped substantially as an hour glass, having a narrow middle portion and large end portions.

5. The hammock of claim 1 wherein the adapter panel forms a pocket for storage adjacent at least one end of the hammock body.

6. The hammock of claim 1 wherein the adapter panel has a head end and a foot end, the foot end providing foot room.

7. The hammock of claim 6 wherein the foot end of the adapter panel is substantially triangular in shape.

8. The hammock of claim 6 wherein the foot end of the adapter panel is at least partly incorporated into the shape of the canopy.

9. The hammock of claim 1 wherein said adapter panel has one edge conforming to the contour of one edge of the hammock body and an opposite edge conforming to the contour of an edge of the canopy, with the adapter panel, the hammock body and the canopy being attached along the edges.

10. The hammock of claim 9 wherein the edge of the adapter panel attached to the edge of the hammock body conforms to a natural shape of a diagonal position to enable loose edges of the hammock body to assume a desired shape when in use.

11. The hammock of claim 1 wherein the adapter panel is removably attached to the hammock body.

12. The hammock of claim 1 wherein the adapter panel is removably attached to the hammock body by a zipper.

13. The hammock of claim 1 wherein the adapter panel is removably attached to the hammock by hook-and-loop combinations.

14. A hammock comprising:

a hammock body gathered at opposite ends to form attachment points for suspension;

a canopy attached to at least one side of the hammock body; and an adapter panel comprising a body with opposite longitudinal edges, the body of the adapter panel attached between the edges of the canopy and edges of the hammock body, the at least one adapter panel joining to the hammock body along only one of the longitudinal edges, and the at least one adapter panel joining to the canopy along only the other one of the longitudinal edge, wherein the body of the adapter panel spans between the opposite longitudinal edges of the adapter panel to join the hammock body to the canopy;

a shelf formed at an intersection of said canopy joining to said adapter panel, said shelf formed from a portion of said adapter panel; and a foot box formed at an intersection of said hammock body joining to said adapter panel, said foot box formed from a portion of said hammock body.

15. The hammock of claim 14 wherein at least a portion of the canopy comprises netting.

16. The hammock of claim 14 wherein the adapter panel is shaped substantially as an hour glass.

17. The hammock of claim 14 wherein the adapter panel has a narrow mid-section and wider portions toward the ends, corresponding to the head and foot ends of the hammock body when installed.

18. The hammock of claim 14 wherein the canopy has a substantially tear-drop shape or a substantially diamond shape.

19. A hammock comprising:

a hammock body having side edges and end edges;

a canopy having a substantially tear-drop shape, the canopy joining to the hammock body along one of the side edges of the hammock body;

an adapter panel with a shape corresponding to the shape of the canopy, the adapter panel having a first longitudinal edge and a second longitudinal edge spaced apart by a body of the adapter panel, the adapter panel joining to the hammock body along only the first longitudinal edge of the adapter panel, and the adapter panel joining to the canopy along only the second longitudinal edge of the adapter panel, wherein the body of the adapter panel joins the hammock body to the canopy; and wherein the adapter panel twists for use;

a shelf formed at an intersection of said canopy joining to said adapter panel, said shelf formed from a portion of said adapter panel; and a foot box formed at an intersection of said hammock body joining to said adapter panel, said foot box formed from a portion of said hammock body.

* * * * *